US009033537B2

(12) United States Patent
Jang et al.

(10) Patent No.: US 9,033,537 B2
(45) Date of Patent: May 19, 2015

(54) CEILING-MOUNTED LIGHT FIXTURE

(75) Inventors: Chul-Ho Jang, Siheung-si (KR); Sung-Han Kim, Siheung-si (KR)

(73) Assignee: EFIDEA, Siheung-Si (KR)

( * ) Notice: Subject to any disclaimer, the term of this patent is extended or adjusted under 35 U.S.C. 154(b) by 417 days.

(21) Appl. No.: 13/638,390

(22) PCT Filed: Mar. 29, 2011

(86) PCT No.: PCT/KR2011/002147
§ 371 (c)(1),
(2), (4) Date: Sep. 28, 2012

(87) PCT Pub. No.: WO2011/122827
PCT Pub. Date: Oct. 6, 2011

(65) Prior Publication Data

US 2013/0021784 A1 Jan. 24, 2013

(30) Foreign Application Priority Data

Mar. 29, 2010 (KR) ..... 10-2010-0027840
Apr. 6, 2010 (KR) ..... 10-2010-0031307

(51) Int. Cl.

| | |
|---|---|
| ***F21V 11/08*** | (2006.01) |
| ***F21V 13/10*** | (2006.01) |
| ***F21S 8/00*** | (2006.01) |
| ***F21V 21/04*** | (2006.01) |
| ***F21V 17/12*** | (2006.01) |
| ***F21V 29/00*** | (2006.01) |

(52) U.S. Cl.
CPC ..... *F21V 21/049* (2013.01); *F21V 17/12* (2013.01); *F21V 29/22* (2013.01)

(58) Field of Classification Search
CPC ..... F21K 9/52; F21S 8/026
USPC ..... 362/147, 360, 338, 341, 356, 551
See application file for complete search history.

(56) References Cited

FOREIGN PATENT DOCUMENTS

| | | | |
|---|---|---|---|
| JP | 62-4018 | U | 1/1987 |
| JP | 09-134611 | A | 1/1997 |
| JP | 10-083714 | A | 3/1998 |
| JP | 2007-265876 | A | 10/2007 |
| JP | 2009-064781 | A | 3/2009 |
| JP | 2009-218007 | A | 9/2009 |
| JP | 2009-266703 | A | 11/2009 |
| JP | 2009-301810 | A | 12/2009 |
| KR | 10-2008-0098762 | A | 11/2008 |

OTHER PUBLICATIONS

JP Notice of Allowance dated Feb. 25, 2014 in application No. 2013-502467.

*Primary Examiner* — Joseph L Williams
(74) *Attorney, Agent, or Firm* — Maschoff Brennan

(57) ABSTRACT

The present invention relates to a ceiling-mounted light fixture configured to be embedded in the ceiling. The ceiling-mounted light fixture comprises: a cylindrical light fixture body having a screw thread formed on the lower end of the outer surface thereof; a light source unit which is accommodated inside the light fixture body and which has a light-emitting element; and a ring-shaped cap which has a screw thread formed on the inner surface thereof to be coupled to the screw thread of the light fixture body. According to the present invention, a ceiling-mounted light fixture is provided, wherein the diameter of the cylinder of the light fixture is increased to achieve improved light distribution efficiency and enable easy assembly.

21 Claims, 6 Drawing Sheets

CEILING-MOUNTED LIGHT FIXTURE

TECHNICAL FIELD

The present invention relates to a ceiling-mounted light fixture configured to be embedded in a ceiling.

BACKGROUND ART

In general, there are a variety of ceiling-mounted light fixtures, cylindrical bodies of which have different diameters according to diameters of ceiling recesses, including 2 inch, 3 inch, 4 inch, 4.5 inch, 5 inch, 6 inch, 8 inch, and 10 inch ceiling-mounted light fixtures.

For example, in the case of a 6-inch light fixture, it must be fabricated so as to be mounted in a ceiling recess having a diameter of 6 inch. Therefore, an actual diameter of the 6-inch light fixture must be less than 6 inch to ensure that the light fixture is firmly and stably fixed to the ceiling. It is desirable to maximize the diameter of a cylindrical light fixture body in order to enhance distribution efficiency of light emitted from the light fixture.

A conventional light fixture includes several elements, such as, for example, a coil spring, a leaf spring, and a fixing bracket, attached to an outer surface of a cylindrical light fixture body. The volume of these several elements, however, inevitably causes a reduction in the diameter of the cylindrical light fixture body, and consequently a reduction in the area of a cover lens, which restricts distribution efficiency of light emitted from the light fixture.

In addition, assembly of the spring used to secure the light fixture to the ceiling needs additional elements, such as, for example, a screw and a rivet, which may disadvantageously increase assembly time and costs.

DISCLOSURE

Technical Problem

Accordingly, the present invention has been devised to solve the above-described problems, and an object of the present invention is to provide a ceiling-mounted light fixture in which a cylindrical light fixture body has a large diameter, thereby ensuring enhanced light distribution efficiency and easy assembly.

Technical Solution

To achieve the above-described technical problem, in accordance with one aspect of the present invention, a ceiling-mounted light fixture includes a cylindrical light fixture body which has a screw thread formed on a lower end of an outer surface thereof, a light source unit which is accommodated inside the light fixture body and which has a light emitting element, and a ring-shaped cap which has a screw thread formed on an inner surface thereof, wherein the screw thread is fastened to the screw thread of the light fixture body.

A plurality of longitudinal spring guide grooves may be indented in the outer surface of the light fixture body so as to protrude inward of the light fixture body, and the ceiling-mounted light fixture may further include a leaf spring including an inserting portion which is inserted in a corresponding one of the spring guide grooves, and a supporting portion which is connected to the inserting portion to support and push the light fixture body toward a ceiling and which protrudes from the spring guide groove.

The light fixture body may include a front barrier configured to obstruct a part of or all of a front opening of the spring guide groove in order to prevent separation of the inserting portion.

The supporting portion may extend through a lateral portion of the spring guide groove.

The supporting portion may be obliquely extended and tapered upward from a horizontal plane.

The supporting portion may extend through a lower end of the spring guide groove.

The inserting portion may have more than one bent portion.

The leaf spring may include a U-shaped bent connecting portion between the inserting portion and the supporting portion.

The supporting portion may have an upwardly convex rounded portion connected to the connecting portion.

The supporting portion may have more than one bent portion.

An end of the supporting portion may be provided with a hook-shaped retaining portion.

The ceiling-mounted light fixture may further include a cover lens between the light fixture body and the cap.

The cover lens may be supported by a protrusion which protrudes from the inner surface of the cap.

A plurality of screw grooves may be formed at an inner surface of the light fixture body.

The ceiling-mounted light fixture may further include a radiator coupled to the light source unit, and the light fixture body may be provided at an inner surface thereof with a stepped portion, and the radiator may be placed on the stepped portion.

A screw thread may be formed at the light fixture body above the stepped portion, and a screw thread may be formed around the radiator, whereby the screw threads of the light fixture body and the radiator are fastened to each other.

The ceiling-mounted light fixture may further include a radiator coupled to the light source unit, the radiator may be placed on a stepped portion formed at an inner surface of the light fixture body, an upper end of the spring guide grooves may have the same height as the stepped portion, and an end of the leaf spring may come into contact with the radiator.

The light emitting element may include at least one of an organic light emitting diode (OLED), a light emitting diode (LED), and a laser diode (LD).

In accordance with another aspect of the present invention to achieve the above-described object, a leaf spring, which is configured to be inserted into a spring guide groove formed in a light fixture body of a ceiling-mounted light fixture so as to support the light fixture, includes an inserting portion which extends vertically so as to be inserted into the spring guide groove, a supporting portion which is connected to the inserting portion and which extends horizontally to protrude from the spring guide groove in order to support and push the light fixture body toward the ceiling, and a U-shaped bent connecting portion between the inserting portion and the supporting portion, wherein the entire leaf spring has an L-shaped form, wherein the inserting portion has more than one bent portion, and wherein the supporting portion has more than one bent portion.

The supporting portion may have an upwardly convex rounded portion connected to the connecting portion.

An end of the supporting portion may be provided with a hook-shaped retaining portion.

Advantageous Effects

According to the present invention, it is possible to provide a ceiling-mounted light fixture in which a cylindrical light fixture body has a large diameter, thereby ensuring enhanced light distribution efficiency and easy assembly.

BEST MODE

Hereinafter, configurations and operations according to exemplary embodiments of the present invention will be described in detail with reference to the accompanying drawings. It is noted that wherever possible, the same reference numbers are used throughout the drawings to refer to the same or like parts.

First Embodiment

Figure 1:
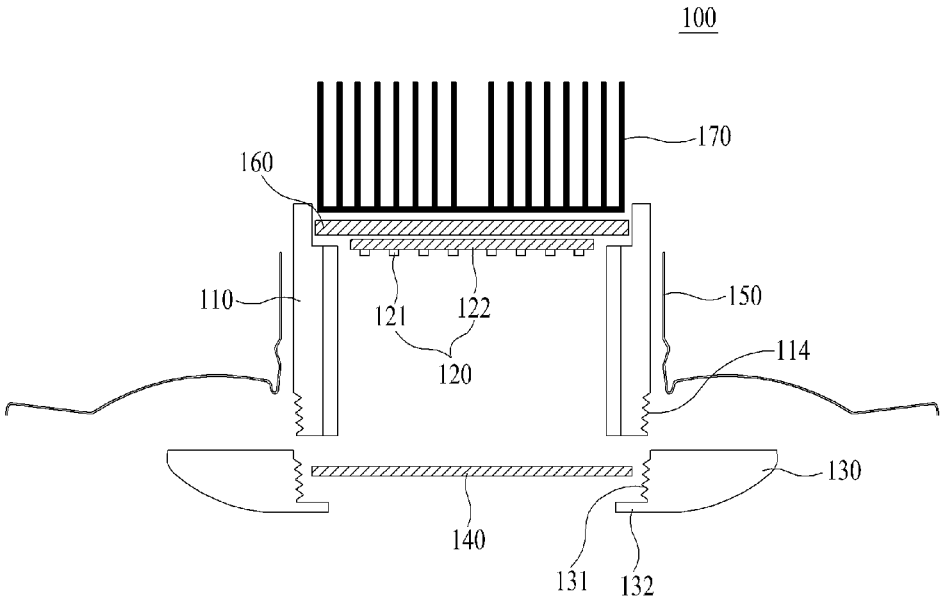
FIG. 1 is a view schematically showing a ceiling-mounted light fixture according to an embodiment of the present invention.
Figure 2:
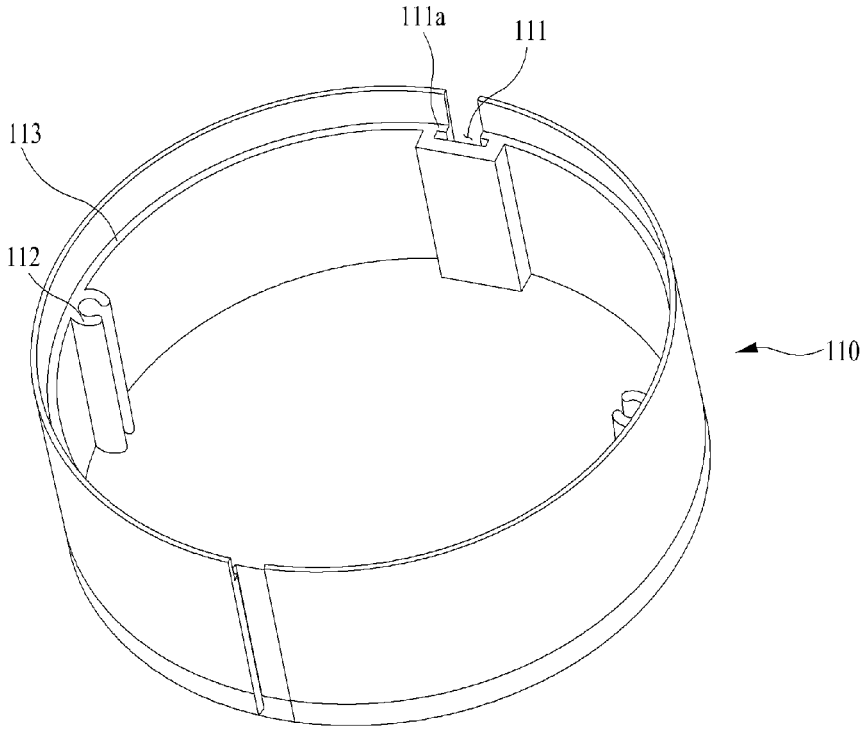
FIG. 2 is a perspective view showing an embodiment of a light fixture body of the ceiling-mounted light fixture shown in FIG. 1.
Figure 3:
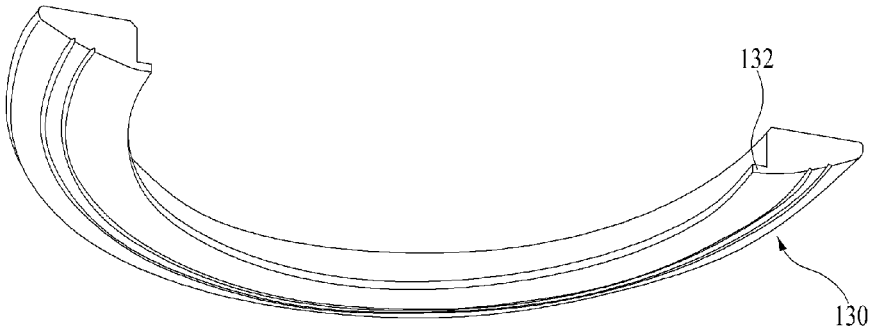
FIG. 3 is a perspective view showing an embodiment of a cap of the ceiling-mounted light fixture shown in FIG. 1.
Figure 4:
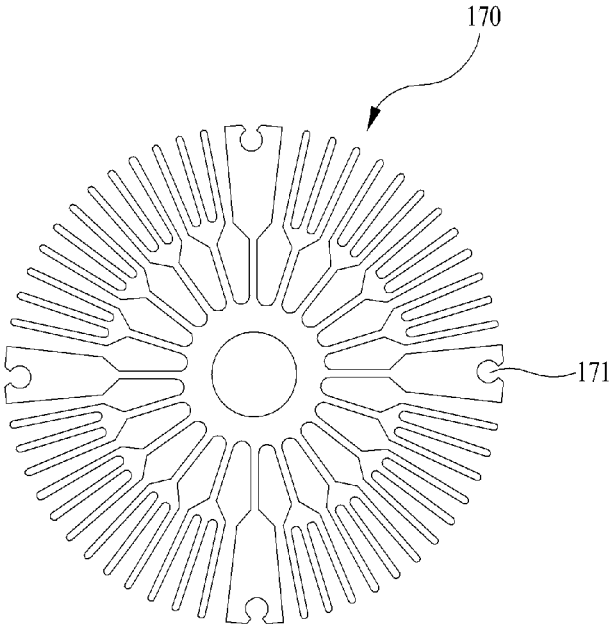
FIG. 4 is a plan view showing an embodiment of a heat sink of the ceiling-mounted light fixture shown in FIG. 1.
Figure 5A:
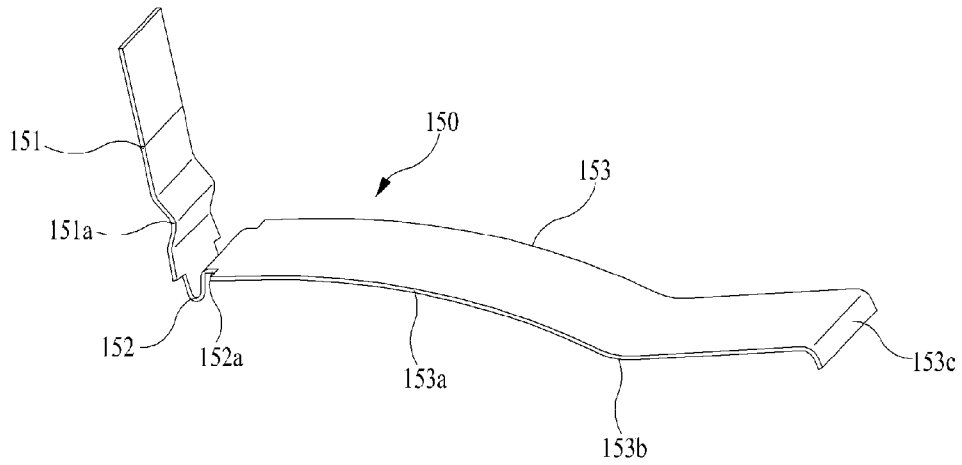
FIG. 5A is a perspective view showing an embodiment of a leaf spring of the ceiling-mounted light fixture shown in FIG. 1.
Figure 5B:
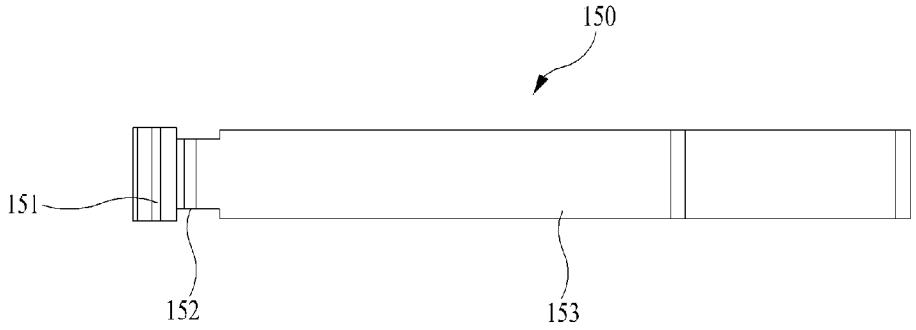
FIG. 5B is a plan view showing the leaf spring of FIG. 5A.
Figure 6:
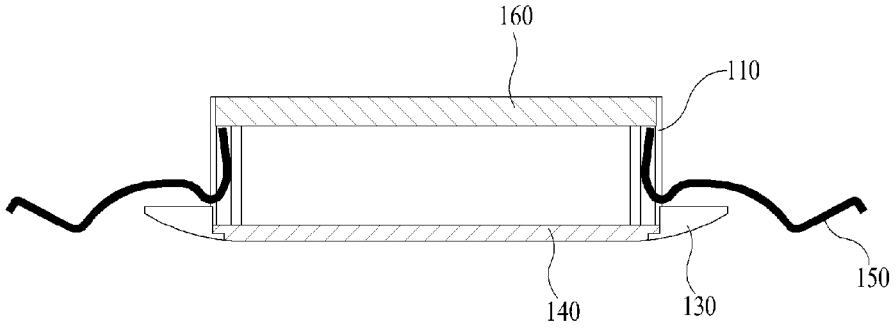
FIG. 6 is a front sectional view showing a state in which the leaf spring of FIG. 5A is inserted into a spring guide groove of the light fixture body.
Figure 7:
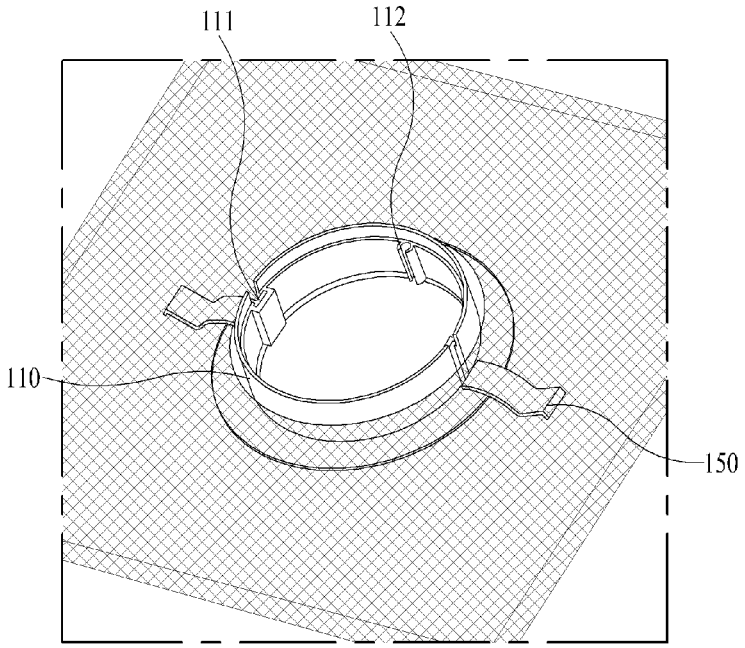
FIG. 7 is a perspective view showing the state in which the leaf spring of FIG. 5A is inserted into the spring guide groove of the light fixture body.

FIG. 1 is a view schematically showing a ceiling-mounted light fixture according to an embodiment of the present invention. FIG. 2 is a perspective view showing an embodiment of a light fixture body of the ceiling-mounted light fixture shown in FIG. 1. FIG. 3 is a perspective view showing an embodiment of a cap of the ceiling-mounted light fixture shown in FIG. 1. FIG. 4 is a plan view showing an embodiment of a heat sink of the ceiling-mounted light fixture shown in FIG. 1. FIG. 5A is a perspective view showing an embodiment of a leaf spring of the ceiling-mounted light fixture shown in FIG. 1. FIG. 5B is a plan view showing the leaf spring of FIG. 5A. FIG. 6 is a front sectional view showing a state in which the leaf spring of FIG. 5A is inserted into a spring guide groove of the light fixture body. FIG. 7 is a perspective view showing the state in which the leaf spring of FIG. 5A is inserted into the spring guide groove of the light fixture body. In FIGS. 2, 3 and 6, the light fixture body and the cap are illustrated with omission of screw threads formed thereon.

The ceiling-mounted light fixture (hereinafter simply referred to as "light fixture") is a light fixture which is configured to be embedded in a ceiling to emit light downward. Various sizes of light fixtures including 2 inch, 3 inch, 4 inch, 4.5 inch, 5 inch, 6 inch, 8 inch, and 10 inch light fixtures, for example, have been fabricated according to diameters of ceiling recesses. For example, in the case of a 6-inch light fixture, it must be fabricated so as to be mounted in a ceiling recess having a diameter of 6 inch. Therefore, an actual diameter of the 6-inch light fixture must be less than 6 inch to ensure that the light fixture is firmly and stably fixed to the ceiling. It is desirable to maximize the diameter of a cylindrical light fixture body in order to enhance distribution efficiency of light emitted from the light fixture.

Referring to FIG. 1, the light fixture 100 according to the present embodiment includes a light fixture body 110, a light source unit 120, a cap 130, a cover lens 140, leaf springs 150, a radiator 160, and a heat sink 170.

The light fixture body 110 takes the form of a cylinder having a predetermined thickness. The light fixture body 110 is configured to accommodate, for example, the light source unit 120 and the radiator 160 therein. The light fixture body 110 is provided at a lower end of an outer surface thereof with a screw thread 114 to be fastened to the cap 130.

A plurality of spring guide grooves 111 is indented in the outer surface of the light fixture body 110 so as to protrude inward of the light fixture body (see FIG. 2). The spring guide grooves 111 extend in a longitudinal direction of the light fixture body 110. The leaf springs 150 are inserted respectively into the spring guide grooves 111 and serve to secure the light fixture 100 to a ceiling finishing material and support the light fixture 100.

To prevent unwanted separation of the leaf springs 150 inserted in the spring guide grooves 111, a front barrier 111*a* is formed at each spring guide groove 111 of the light fixture body 110. The front barrier 111*a* is configured to obstruct a part of or all of a front opening of the spring guide groove 111. Although the front barrier 111*a* is illustrated in FIG. 2 as obstructing a part of the front opening of the spring guide groove 111, the front opening of the spring guide groove 111 may be completely covered. In this case, the leaf spring 150 has to be inserted from a lower end of the light fixture body 110.

A plurality of screw grooves 112 is formed at an inner surface of the light fixture body 110. The screw grooves 112 have a C-shaped cross section such that screws are fitted into the screw grooves 112 to fasten the light fixture body 110, a printed circuit board 122, the radiator 160, and the heat sink 170 with one another. Providing the screw grooves eliminates a need for additional screw machining, which has the effect of achieving a reduction in screw machining costs.

Additionally, the light fixture body 110 has a stepped portion 113. The radiator 160 may be placed on and supported by the stepped portion 113. Preferably, upper ends of the screw grooves 112 and the spring guide grooves 111 have the same height as the stepped portion 113.

The light source unit 120 is accommodated in the light fixture body 110 and serves to emit light. The light source unit 120 may include light emitting elements 121 to emit light, and the printed circuit board 122 on which the light emitting elements 121 are mounted. The light emitting elements 121 may include at least one selected from among Light Emitting Diodes (LEDs), Organic Light Emitting Diodes (OLEDs), and Laser Diodes (LDs). Preferably, the light emitting elements 121 may be LEDs.

The cap 130 has a ring shape and is provided at an inner surface thereof with a screw thread 131 to be fastened to the screw thread 114 provided at the outer surface of the light fixture body 110. As such, the cap 130 and the light fixture body 110 are fastened to each other via the screw threads 114 and 131. The cap 130 has a protrusion 132 to support the cover lens 140.

When the light fixture 100 is embedded in the ceiling, the cap 130 is a portion that is exposed outward of the ceiling finishing material, such as a textile fabric, a plywood board, and a gypsum board, for example. The light fixture 100 may be firmly secured in a ceiling recess by means of the leaf springs 150 that is located inside of the ceiling finishing material and the cap 130 that protrudes outward of the ceiling finishing material.

In a state in which the light fixture 100 is installed to the ceiling, the light fixture body 110 is inserted in the ceiling recess and the cap 130 comes into contact with a ceiling surface. Also, the cap serves to support the cover lens 140 by the protrusion 132 thereof, thereby assisting coupling of the cover lens 140 to the light fixture body 110.

The cover lens 140 is located between the light fixture body 110 and the cap 130, and serves to disperse light emitted from the light emitting devices 121. The cover lens 140 may be assembled by inserting the cover lens 140 between the light fixture body 110 and the cap 130, and then turning the light fixture body 110 and the cap 130 to enable fastening of the screw threads thereof. As such, the cover lens 140 may be firmly secured between the light fixture body 110 and the cap 130 within the movement range of the screw threads regardless of the thickness of the cover lens 140.

The cover lens 140 may be formed of glass, or may be formed of plastics, such as polycarbonate and acryl, for example. The cover lens 140 may be supported by the protrusion 132 of the cap 130.

The radiator 160 may be coupled to the light source unit 120 and serve to radiate heat generated from the light emitting elements 121 via conduction. The radiator 160 may be placed on the stepped portion 113 of the light fixture body 110. Alternatively, it may be contemplated that the printed circuit board 122 of the light source unit 120 is placed on the stepped portion 113 and the radiator 160 is placed on the printed circuit board 122.

The heat sink 170 may be disposed on the radiator 160, and serve to further radiate heat transferred to the radiator 160. Referring to FIG. 4, the heat sink 170 may have various shapes suitable to increase a heat transfer area. The heat sink 170 may have screw grooves 171 corresponding to the screw grooves 112.

Referring to FIGS. 5A and 5B, the leaf spring 150 includes an inserting portion 151, a connecting portion 152, and a supporting portion 153.

The inserting portion 151 is a portion that is inserted into the spring guide groove 111 of the light fixture body 110. The inserting portion 151 may be inserted into the spring guide groove 111 from top to bottom. The inserting portion 151 may have more than one bent portion 151*a*. The bent portion 151*a* may assist the inserting portion 151 in being firmly secured to the spring guide groove 111 even if the thickness of the leaf spring 150 is small.

The connecting portion 152 takes charge in connection between the inserting portion 151 and the supporting portion 153. The connecting portion 152 has a U-shaped form to enhance the elasticity and rigidity of the entire leaf spring 150. The connecting portion 152 has a reduced width portion 152*a* to assist the supporting portion 153 of the leaf spring 150 in escaping from a lower end of the spring guide groove 111.

The supporting portion 153 protrudes from the spring guide groove 1110 to extend approximately in a horizontal direction in order to support and push the light fixture body 110 toward the ceiling. When the light fixture 100 is embedded in the ceiling recess formed in the ceiling finishing material, the supporting portion 153 extends above the ceiling finishing material so as to support the light fixture 100.

The supporting portion 153 has an upwardly convex rounded portion 153*a* connected to the connecting portion 152. The rounded portion 153*a* ensures that the leaf spring 150 is secured to the ceiling finishing material regardless of the thickness of the ceiling finishing material.

The supporting portion 153 may have more than one bent portion 153*b* to enhance rigidity. Additionally, a hook-shaped retaining portion 153*c* is provided at a distal end of the supporting portion 153. Even if the light fixture 100 falls from the ceiling upon occurrence of earthquake, for example, the retaining portion 153*c* may be finally captured by the ceiling finishing material, thereby preventing accidents due to fall of the light fixture 100.

In the case of the previously described conventional light fixture, due to the fact that several elements, such as a coil spring, a leaf spring, and a fixing bracket, for example, are attached to an outer surface of a light fixture body, it requires a spatial volume for attachment of the springs and the fixing bracket, and thus must have a relatively small diameter of the light fixture body. This causes a reduction in the area of a cover lens, resulting in restricted distribution efficiency of light emitted from the light fixture. In addition, assembly of the springs used to secure the light fixture to the ceiling needs additional elements, such as a screw and a rivet, for example, which may disadvantageously increase assembly time and costs.

According to the above-described present embodiment, the light fixture body 110 and the cap 130 are coupled to each other via fastening between the screw thread formed on the outer surface of the light fixture body 110 and the screw thread formed on the inner surface of the cap 130. This ensures that the cover lens 140 located between the light fixture body 110 and the cap 130 may be shaped to have a large diameter substantially equal to the inner diameter of the cap 130 (i.e. the outer diameter of the light fixture body 110). Accordingly, it is possible to increase the emission area of light emitted from the light emitting elements 121 through the cover lens 140, resulting in enhanced light distribution efficiency.

Moreover, the leaf spring 150 used to secure the light fixture 100 to the ceiling finishing material is inserted into the spring guide groove 111 formed in the outer surface of the light fixture body 110 so as to extend outward of the light fixture body 110. An upper end of the leaf spring 150 may be secured by the radiator 160 placed on the stepped portion 113.

With the above-described configuration, the outer diameter of the light fixture body 110 and the diameter of the cover lens 140 may be increased, which results in enhanced light distribution efficiency. The above-described configuration further advantageously eliminates use of fastening elements, such as a screw and a rivet, for example, to assembly the leaf spring 150 with the light fixture body 110, and also ensures easy and rapid assembly of the leaf spring 150 with respect to the light fixture body 110. In addition, the radiator 160 comes into contact with the metallic leaf spring 150, which advantageously enables additional radiation through the leaf spring 150.

Moreover, as the heat generated from the light emitting elements 121 is radiated throughout the light fixture 100 through the radiator 160, the leaf spring 150, and the heat sink 170, the reliability of the light emitting elements 121 may be enhanced.

Second Embodiment

Figure 8:
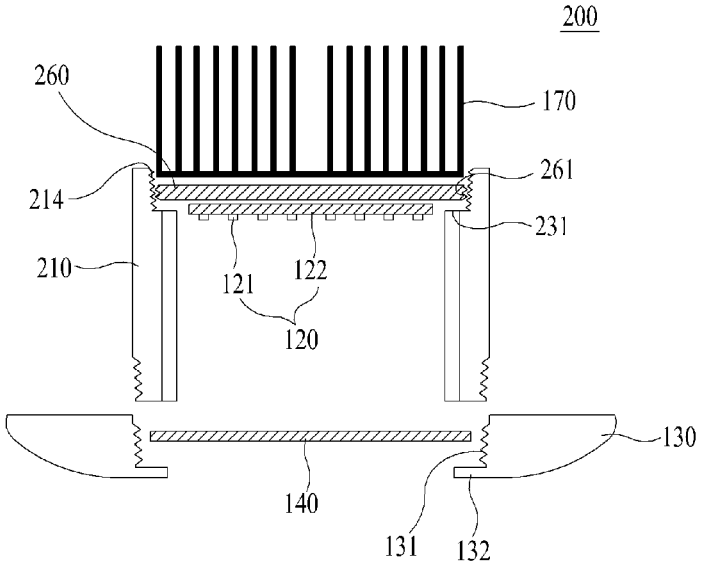
FIG. 8 is a view schematically showing a ceiling-mounted light fixture according to another embodiment of the present invention.

FIG. 8 is a view schematically showing a ceiling-mounted light fixture according to another embodiment of the present invention. The same parts as those of the ceiling-mounted light fixture shown in FIG. 1 are indicated by the same reference numerals, and a repeated description thereof will be omitted hereinafter.

In the present embodiment, a screw thread 214 is formed on an inner surface of a light fixture body 210 above a stepped portion 231. Also, a screw thread 261 is formed on an outer surface of a radiator 260. As such, once the radiator 260 has been placed on the stepped portion 231 of the light fixture body 210, the radiator 260 may be secured via fastening between the screw thread 214 and the screw thread 261. This allows the radiator 260 to be closely assembled with the light fixture body 210 in a simplified manner.

The printed circuit board 122 is placed on the stepped portion 231 of the light fixture body 210, and in turn the radiator 260 is placed on the printed circuit board 122. Thereby, the light fixture body 210 and the radiator 260 may be coupled to each other via the screw threads.

Third Embodiment

Figure 9:
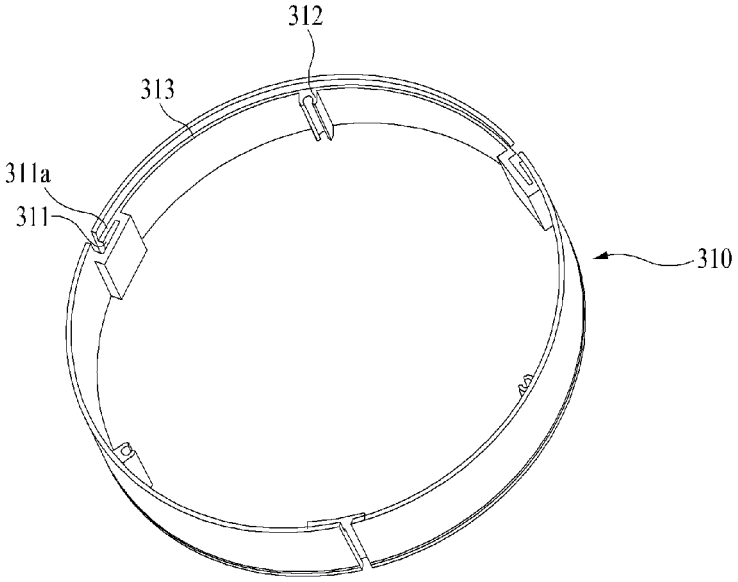
FIG. 9 is a perspective view showing another embodiment of the light fixture body of the ceiling-mounted light fixture shown in FIG. 1.
Figure 10:
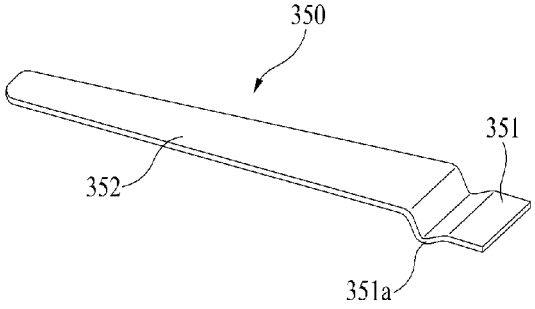
FIG. 10 is a perspective view showing another embodiment of the leaf spring of the ceiling-mounted light fixture shown in FIG. 1.
Figure 11:
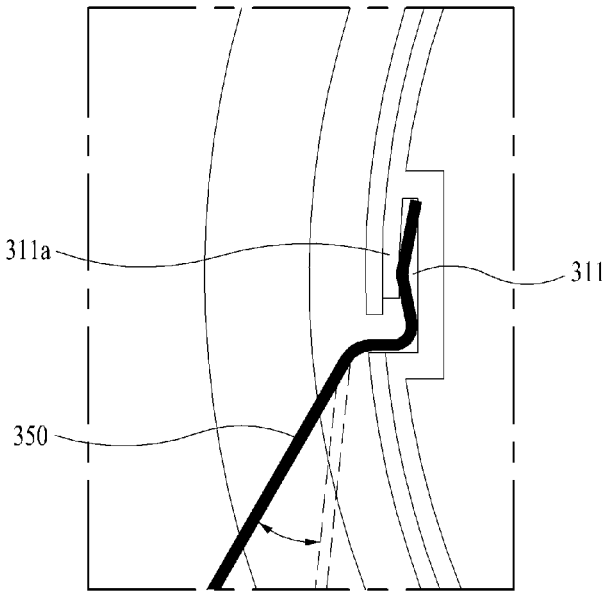
FIG. 11 is a plan sectional view showing a state in which the leaf spring of FIG. 10 is inserted into the light fixture body of FIG. 9.
Figure 12:
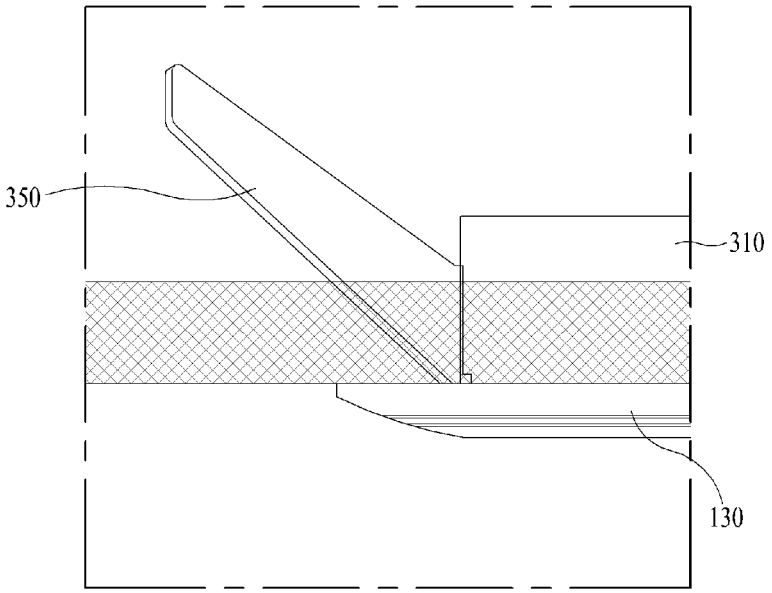
FIG. 12 is a front sectional view showing the state in which the leaf spring of FIG. 10 is inserted into the light fixture body of FIG. 9.

FIG. 9 is a perspective view showing another embodiment of the light fixture body of the ceiling-mounted light fixture shown in FIG. 1. FIG. 10 is a perspective view showing another embodiment of the leaf spring of the ceiling-mounted light fixture shown in FIG. 1. FIG. 11 is a plan sectional view showing a state in which the leaf spring of FIG. 10 is inserted into the light fixture body of FIG. 9. FIG. 12 is a front sectional view showing the state in which the leaf spring of FIG. 10 is inserted into the light fixture body of FIG. 9. In FIG. 9, the light fixture body is illustrated with omission of a screw thread formed thereon.

A light fixture body 310 takes the form of a cylinder having a predetermined thickness. The light fixture body 110 is configured to accommodate, for example, the light source unit and the radiator therein. The light fixture body 310 has plurality of spring guide grooves 311, which are indented in the outer surface thereof so as to protrude inward of the light fixture body. The spring guide grooves 311 extend in a longitudinal direction of the light fixture body 310. Leaf springs 350 are inserted respectively into the spring guide grooves 311, and serve to secure the light fixture 300 to the ceiling and support the light fixture 300.

To prevent unwanted separation of the leaf springs 350 inserted in the spring guide grooves 311, a front barrier 311*a* is formed at each spring guide groove 311 of the light fixture body 310. The barrier 311*a* is configured to obstruct a part of or all of a front opening of the spring guide groove 311.

A plurality of screw grooves 312 is formed at an inner surface of the light fixture body 310. The screw grooves 312 have a C-shaped cross section such that screws are fitted into the screw grooves 312 to fasten the light fixture body 310, the printed circuit board, the radiator, and the heat sink, for example, with one another.

Additionally, the light fixture body 310 has a stepped portion 313. The radiator may be placed on the stepped portion 313. Preferably, upper ends of the screw grooves 312 and the spring guide grooves 311 have the same height as the stepped portion 313.

The leaf spring 350 includes an inserting portion 351 and a supporting portion 352.

The inserting portion 351 is a portion that is inserted into the spring guide groove 311 of the light fixture body 310. The inserting portion 351 may have more than one bent portion 351*a*. The bent portion 351*a* may assist the inserting portion 351 in being firmly secured to the spring guide groove 311.

The supporting portion 352 protrudes laterally from the spring guide groove 311 to support and push the light fixture body 310 toward the ceiling. When the light fixture is embedded in the ceiling recess indented in the ceiling finishing material, the supporting portion 352 extends above the ceiling finishing material so as to support the light fixture.

The supporting portion 352 may be elastically bent in a state in which the inserting portion 351 is inserted in the spring guide groove 311.

Referring to FIGS. 10 and 12, the supporting portion 352 is obliquely extended and tapered upward from a horizontal plane. This configuration ensures that the leaf spring 350 may extend above the ceiling finishing material while being inserted in the spring guide groove 311. In addition, owing to the inclination angle of the supporting portion 352, the leaf spring may extend above the ceiling finishing material even if the thickness of the ceiling finishing material varies within a predetermined range.

In the present embodiment in which the supporting portion 352 of the leaf spring 350 protrudes laterally from the spring guide groove 311, even if shock is applied to the light fixture, the elastic bending direction of the supporting portion 352 and the fall direction of the light fixture differ from each other, which ensures that the supporting portion 352 prevents fall of the light fixture.

[Mode for Intention]

Those skilled in the art will appreciate that the present invention is not limited to the above-described embodiments, and various modifications and substitutions are possible without departing from the scope and spirit of the invention.

[Industrial Applicability]

According to the present invention, it is possible to provide a ceiling-mounted light fixture in which a cylindrical light fixture body has a large diameter, thereby ensuring enhanced light distribution efficiency and easy assembly.

The invention claimed is:

1. A ceiling-mounted light fixture comprising:

a cylindrical light fixture body which has a screw thread formed on a lower end of an outer surface thereof;

a light source unit which is accommodated inside the light fixture body and which has a light emitting element; and a ring-shaped cap which has a screw thread formed on an inner surface thereof, wherein the screw thread is fastened to the screw thread of the light fixture body.

2. The ceiling-mounted light fixture according to claim 1, wherein a plurality of longitudinal spring guide grooves is indented in the outer surface of the light fixture body so as to protrude inward of the light fixture body, and wherein the ceiling-mounted light fixture further comprises a leaf spring including an inserting portion which is inserted in a corresponding one of the spring guide grooves, and a supporting portion which is connected to the inserting portion to support and push the light fixture body toward a ceiling and which protrudes from the spring guide groove.

3. The ceiling-mounted light fixture according to claim 2, wherein the light fixture body includes a front barrier configured to obstruct a part of or all of a front opening of the spring guide groove in order to prevent separation of the inserting portion.

4. The ceiling-mounted light fixture according to claim 3, wherein the supporting portion extends through a lateral portion of the spring guide groove.

5. The ceiling-mounted light fixture according to claim 4, wherein the supporting portion is obliquely extended and tapered upward from a horizontal plane.

6. The ceiling-mounted light fixture according to claim 3, wherein the supporting portion extends through a lower end of the spring guide groove.

7. The ceiling-mounted light fixture according to claim 4, wherein the inserting portion has more than one bent portion.

8. The ceiling-mounted light fixture according to claim 6, wherein the leaf spring includes a U-shaped bent connecting portion between the inserting portion and the supporting portion.

9. The ceiling-mounted light fixture according to claim 8, wherein the supporting portion has an upwardly convex rounded portion connected to the connecting portion.

10. The ceiling-mounted light fixture according to claim 8, wherein the supporting portion has more than one bent portion.

11. The ceiling-mounted light fixture according to claim 8, wherein an end of the supporting portion is provided with a hook-shaped retaining portion.

12. The ceiling-mounted light fixture according to claim 1, further comprising a cover lens between the light fixture body and the cap.

13. The ceiling-mounted light fixture according to claim 12, wherein the cover lens is supported by a protrusion which protrudes from the inner surface of the cap.

14. The ceiling-mounted light fixture according to claim 1, wherein a plurality of screw grooves is formed at an inner surface of the light fixture body.

15. The ceiling-mounted light fixture according to claim 1, further comprising a radiator coupled to the light source unit, wherein the light fixture body is provided at an inner surface thereof with a stepped portion, and the radiator is placed on the stepped portion.

16. The ceiling-mounted light fixture according to claim 15, wherein a screw thread is formed at the light fixture body above the stepped portion, and a screw thread is formed around the radiator, whereby the screw threads of the light fixture body and the radiator are fastened to each other.

17. The ceiling-mounted light fixture according to claim 2, further comprising a radiator coupled to the light source unit, wherein the radiator is placed on a stepped portion formed at an inner surface of the light fixture body, wherein an upper end of the spring guide grooves has the same height as the stepped portion, and wherein an end of the leaf spring comes into contact with the radiator.

18. The ceiling-mounted light fixture according to claim 1, wherein the light emitting element includes at least one of an organic light emitting diode (OLED), a light emitting diode (LED), and a laser diode (LD).

19. A leaf spring configured to be inserted into a spring guide groove formed in a light fixture body of a ceiling-mounted light fixture so as to support the light fixture, the leaf spring comprising:

an inserting portion which extends vertically so as to be inserted into the spring guide groove;

a supporting portion which is connected to the inserting portion and which extends horizontally to protrude from the spring guide groove in order to support and push the light fixture body toward the ceiling; and a U-shaped bent connecting portion between the inserting portion and the supporting portion, wherein the entire leaf spring has an L-shaped form, wherein the inserting portion has more than one bent portion, and wherein the supporting portion has more than one bent portion.

20. The leaf spring according to claim 19, wherein the supporting portion has an upwardly convex rounded portion connected to the connecting portion.

21. The leaf spring according to claim 20, wherein an end of the supporting portion is provided with a hook-shaped retaining portion.

* * * * *